US008223037B2

(12) United States Patent
Grotendorst et al.

(10) Patent No.: US 8,223,037 B2
(45) Date of Patent: Jul. 17, 2012

(54) METHOD AND APPARATUS FOR WARNING OF EMERGENCY VEHICLES IN EMERGENCY SERVICE

(75) Inventors: Thomas Grotendorst, Eschborn (DE); Ulrich Stählin, Eschborn (DE)

(73) Assignee: Continental Teves AG & Co. oHG (DE)

( * ) Notice: Subject to any disclaimer, the term of this patent is extended or adjusted under 35 U.S.C. 154(b) by 271 days.

(21) Appl. No.: 12/674,998

(22) PCT Filed: Aug. 14, 2008

(86) PCT No.: PCT/EP2008/060719

§ 371 (c)(1),
(2), (4) Date: Feb. 24, 2010

(87) PCT Pub. No.: WO2009/027245

PCT Pub. Date: Mar. 5, 2009

(65) Prior Publication Data

US 2011/0115644 A1 May 19, 2011

(30) Foreign Application Priority Data

Aug. 29, 2007 (DE) ..... 10 2007 041 045
Aug. 14, 2008 (DE) ..... 10 2008 037 690

(51) Int. Cl.
*G08G 1/16* (2006.01)

(52) U.S. Cl. ..... 340/903; 701/300; 342/454

(58) Field of Classification Search ..... 340/901–907; 701/200–213, 300–302, 400, 408, 418, 515, 701/32.3; 342/454–458
See application file for complete search history.

(56) References Cited

U.S. PATENT DOCUMENTS

| | | | | |
|---|---|---|---|---|
| 5,345,232 | A * | 9/1994 | Robertson | 340/906 |
| 6,958,707 | B1 * | 10/2005 | Siegel | 340/902 |
| 7,099,776 | B2 * | 8/2006 | King et al. | 701/454 |
| 2002/0105418 | A1 | 8/2002 | Yurimoto et al. | |
| 2005/0192746 | A1 | 9/2005 | King et al. | |
| 2005/0270146 | A1 * | 12/2005 | Enya et al. | 340/438 |
| 2007/0132608 | A1 | 6/2007 | Votaw et al. | |

FOREIGN PATENT DOCUMENTS

| | | | |
|---|---|---|---|
| DE | 195 08 043 | C1 | 8/1996 |
| DE | 299 06 965 | U1 | 10/1999 |
| DE | 199 17 792 | A1 | 9/2000 |
| DE | 100 33 859 | A1 | 1/2002 |
| DE | 100 53 099 | A1 | 5/2002 |
| DE | 10 2004 012 104 | A1 | 10/2005 |
| DE | 10 2006 060 562 | A1 | 6/2008 |

* cited by examiner

*Primary Examiner* — George Bugg
*Assistant Examiner* — Edny Labbees
(74) *Attorney, Agent, or Firm* — RatnerPrestia

(57) ABSTRACT

A method and an apparatus for warning of emergency vehicles in emergency service. The emergency vehicles use vehicle-to-vehicle communication to transmit warning messages which are received by other vehicles and are indicated to the driver of the receiving vehicle. In order to allow rapid orientation of the driver, provision is made for the warning message from the emergency vehicle to have a position statement for the emergency vehicle and for the position statement to be evaluated in the vehicle which receives the warning message, wherein the position of the emergency vehicle is indicated relative to the position of the receiving vehicle.

14 Claims, 2 Drawing Sheets

METHOD AND APPARATUS FOR WARNING OF EMERGENCY VEHICLES IN EMERGENCY SERVICE

CROSS REFERENCE TO RELATED APPLICATIONS

This application is the U.S. national phase application of PCT International Application No. PCT/EP2008/060719, filed Aug. 14, 2008, which claims priority to German Patent Application No. 10 2007 041 045.1, filed Aug. 29, 2007, and German Patent Application No. 10 2008 037 690.6, filed Aug. 14, 2008, the contents of such applications being incorporated by reference herein.

FIELD OF THE INVENTION

The invention relates to a method and an apparatus for warning of emergency vehicles in emergency service, which involve emergency vehicles using vehicle-to-vehicle communication to transmit warning messages which are received by other vehicles and are indicated to the driver of the receiving vehicle.

BACKGROUND OF THE INVENTION

For some considerable time, thoughts have already turned to how to improve the safety of emergency vehicles in emergency service. The highway code awards special rights to emergency vehicles which indicate emergency service by means of a blue light and a horn, said special rights being intended to allow said emergency vehicles to reach their destination faster than other, civil vehicles. However, the special rights recurrently produce hazard situations, particularly when the horn and/or the blue light are/is not noticed by the other road users or only noticed late. In this case, junctions with traffic lights are particularly at risk when the emergency vehicles in emergency service enter the junction area on "red".

To be able to better warn the other road users, DE 200 07 251 U1, which is incorporated by reference, proposes an arrangement having a vehicle-mounted transmitter which emits an electromagnetic radio signal or an infrared signal which is received by a receiver installed at a set of traffic lights. A frequency or phase comparison method can be used to infer from the received signal whether the emergency vehicle is moving towards or away from the junction and how far away it is from the junction at the time. If particular criteria are met then the traffic lights can be switched to a warning state which indicates to the civil traffic, for example by means of a rapidly flashing red light, that an emergency vehicle is approaching. Although this increases the attention of the road users, the yield of information is comparatively small, since neither the time nor the direction from which the emergency vehicle is approaching are indicated.

DE 195 08 043 C1, which is incorporated by reference, discloses a control arrangement in which a traffic lights computer stores all approaches to a junction by capturing GPS coordinates. An emergency vehicle continually transmits its position data in the form of GPS coordinates for reception by the traffic lights computer. These are used to ascertain the trajectory of the emergency vehicle. It is thus possible to predict at what time the emergency vehicle will cross the junction, possibly even in which direction, so that one arm of the junction can be provided with exclusive privilege. However, the installation of such a system is very complex both in terms of hardware complexity and in terms of the capture of the junction coordinates in the traffic lights computer.

As an extension to this system, the thesis by M. Stein, "Erstellung einer Fahrwegfreischaltung für Einsatzfahrzeuge an Ampelkreuzungen basierend auf Fahrzeug-zu-Infrastruktur Kommunikation" [Production of roadway clearance for emergency vehicles at traffic-light junctions on the basis of vehicle-to-infrastructure communication], Darmstadt Technical University, 2007, which is incorporated by reference, discloses roadway clearance for emergency vehicles at traffic-light junctions which involves learning a digital map of the surroundings by communicating with civil road users. Following the learning process, an emergency vehicle trajectory ascertained using a direction-based algorithm is classified on the basis of said learnt map. This facilitates the setup of the roadway clearance at the installation, so that the proposed method is also suitable for mobile traffic lights, for example. The roadway clearance certainly increases road safety as a whole.

However, this does not improve orientation for the civil road users sensing the horn of an emergency vehicle. In particular, experience shows that it is a problem for the driver of a vehicle involved in the traffic to identify where the emergency vehicle is located when the horn is sensed. The result of this is that the driver is frequently unable to react to the warning in a manner appropriate to the situation.

It is therefore an object of the present invention to propose a means of improved location of an emergency vehicle by a civil road user.

SUMMARY OF THE INVENTION

The proposed method has provision, in particular, for the warning message from the emergency vehicle to have a position statement for the emergency vehicle and for the position statement to be evaluated in the vehicle which receives the warning message, wherein the position of the emergency vehicle is indicated relative to the position of the driver's own vehicle. In contrast to a simple warning message, in this way the indication additionally provides the driver with the information regarding where the emergency vehicle in emergency service is situated relative to his own, receiving vehicle. The position statement may simply be a coordinate in the coordinate system of a navigation and/or position-finding system, which coordinate is transmitted from the emergency vehicle to the receiving vehicle at the same time by the warning message, for example. However, it is also possible for the position relative to the driver's own, receiving vehicle to be derived from parameters for the vehicle-to-vehicle communication. Particularly when using radio communication which is based on the WLAN standard, said radio communication being employed for the vehicle-to-vehicle communication, it is possible to establish the direction of the transmitter relative to the receiver and possibly also the distance thereof.

It is particularly advantageous if the position statement for the emergency vehicle and possibly also a position statement for the receiving vehicle is/are used for performing map matching, which involves the position statement being attributed to a digital road map. This provides the driver of the receiving vehicle with optimum information relating to the traffic situation and the relative position of his own vehicle with respect to the emergency vehicle in emergency service. This method variant can be implemented in various ways.

In a first variant, the receiving vehicle itself is equipped with a position-finding system, which is set up to perform map matching, with a digital map and performs the map matching directly after receipt of the warning message with a position statement. Often, relatively small vehicles, in particular, are not equipped with position-finding systems of such complexity, but rather have only a receiver for the position-finding system, for example a GPS receiver, in order to transmit the position of the vehicle in the event of an automatic emergency call (Ecall). In this case, the map matching cannot be performed in the vehicle itself. In line with a second variant, however, it is possible for the vehicle to report back its own position to the emergency vehicle using vehicle-to-vehicle communication when a warning message is received. The emergency vehicle can then perform the map matching and can return the positions of the emergency vehicle and of the receiving vehicle together with the required data for the presentation of a map of the surroundings to the receiving vehicle. In this case, the position statement for the emergency vehicle and/or for the receiving vehicle is thus attributed in the emergency vehicle.

Usually, the emergency vehicle has a particularly good level of technical equipment and, on top of position coordinates from the position-finding system, can also use further information, for example from an ambient sensor system or vehicle-to-vehicle and/or vehicle-to-infrastructure communication, in order to further refine the position coordinates from the position-finding system and, by way of example, also to perform lane recognition. These data can be sent to the receiving vehicle, if appropriate also on their own. In a simple modification of this proposal, the map of the surroundings can be transmitted with the position data for the emergency vehicle as standard in a hazard message. The receiving vehicle can then make direct use of said concurrently transmitted digital map of the surroundings in order to also enter the known position of the driver's own (receiving) vehicle and to present the map of the surroundings updated in this manner. Merely in the event of attribution problems, the receiving vehicle can then also send its position coordinates to the emergency vehicle in order to return a complete map of the surroundings with the positions of both the receiving vehicle and the emergency vehicle, as described previously.

In line with a preferred further development of the proposed method, the warning message from the emergency vehicle may also have a direction statement for the emergency vehicle. This can be transmitted concurrently in the warning message as an explicit direction statement, for example, or can ensue by virtue of continual transmission of position statements which are evaluated in the receiving vehicle and are converted into a direction statement for the emergency vehicle. It is naturally also possible for the direction statement to be ascertained in the emergency vehicle in the same way by evaluating the timing of successive position statements. In this case, the direction of movement of the emergency vehicle can then preferably be transmitted straightaway in the warning message. This has the advantage that the direction statement is available in the receiving vehicles more quickly, since the direction of movement is known as early as when a warning message is received for the first time and it is not necessary to wait for further position statements and for the evaluation thereof.

In line with the invention, the transmission of the warning messages may be coupled directly to the switching-on of the special symbols in the emergency vehicle. In this case, the warning messages are thus transmitted as soon as the special signal is switched on, and are deactivated again as soon as the special signal is switched off in the emergency vehicle.

In line with the invention, the position of the emergency vehicle can be indicated in the receiving vehicle by an arrow in an indicator device, for example a driver information display or the display of an HMI (Human Machine Interface), wherein the arrow tip points in the direction of the emergency vehicle relative to the receiving vehicle. In this case, the arrow can be presented and pointed on the basis of the direction of travel of the driver's own receiving vehicle, for example, which typically matches the sitting and viewing direction of the driver of the receiving vehicle. In this illustration based on a very simple embodiment of the invention, the direction of movement of the emergency vehicle is not yet shown. However, the driver knows where the emergency vehicle is located and is thus able to orient himself quickly.

In a preferred further development of the present invention, the indicator also presents, particularly in addition to the position indicator, the direction of the emergency vehicle, particularly by means of an arrow in an indicator device, the arrow tip of which points in the direction of movement of the emergency vehicle relative to the direction of travel of the receiving vehicle. This arrow presentation can also be combined with the presentation of the position statement by an arrow, for example using different arrow presentations. The presentations may differ, in line with the invention, in terms of color, size or other features. In line with the invention, it is possible to present the direction and position of the emergency vehicle and preferably also of the receiving vehicle by means of a respective common arrow, with the different speeds of the vehicles being able to be factored in by arrows of different length, for example.

In this case, the indicator thus contains an arrow for the emergency vehicle and an arrow for the driver's own vehicle. In line with the invention, the speed of the emergency vehicle can ensue either by virtue of an explicit transmission in the vehicle-to-vehicle communication or by evaluating the timing of the successively transmitted positions of the emergency vehicle.

If appropriate, the emergency vehicle and the driver's own, receiving vehicle can also be presented by arrows or other suitable presentation means in a stylized map of the surroundings, which possibly indicates only the position of the driver's own (receiving) vehicle and the emergency vehicle and reproduces the timing of, preferably, an approach or departure by the vehicle. By way of example, such a presentation is similar to the presentation in a radar image.

Particularly if the position of the emergency vehicle and the position of the driver's own, i.e. receiving, vehicle are subjected to map matching, which involves the position of the emergency vehicle and the position of the driver's own vehicle having been aligned with a digital road map, the positions and possibly directions of the driver's own vehicle and of the emergency vehicle can also be presented in a map presentation of a navigation system. In this regard, it can be proposed in line with the invention that, when a warning message is received, the map presentation of a navigation system automatically selects a suitable map detail, the size of which is determined such that preferably the driver's own vehicle and the emergency vehicle in emergency service are presented on the map detail and at the same time the route is identifiable, in which case the presentation may be limited to roads which are relevant to the two vehicles. In this presentation, the driver of the receiving vehicle can obtain an overview of the traffic situation at a glance and can react in a suitable manner. In this case, too, the driver's own vehicle and the emergency vehicle can, for the sake of clarity, be presented by arrows or suchlike conspicuous markers which move in the digital map detail, with the length of the arrows possibly being selected on the basis of the speeds of the two vehicles in order to indicate different speeds at first glance. The arrows are then orientated on the basis of the directions prescribed by the digital map.

In line with an additional or alternative presentation of the position of the emergency vehicle, a surround-sound-compatible loudspeaker installation can be used to produce a signal tone such that the signal tone appears to the driver of the receiving vehicle to come from the direction of approach of the emergency vehicle. By way of example, the signal tone may be the emulation of a siren to which the driver is accustomed. In this case, the production of the signal tones can also be adapted to suit circumstances typical of the country and can be prescribed by an appropriate configuration. The configuration can also ensue automatically within a navigation system which has knowledge of the country in which the vehicle is currently situated. In line with one preferred further development of the method, the production of the signal tone involves other reproductions on the loudspeaker installation being switched off or reduced in volume such that the signal tone is clearly audible and the direction is clearly identifiable. Regardless of whether the warning message is output as a signal tone, the loudspeaker installation can, in line with the invention, be switched off by an emergency vehicle whenever a warning message is received, even if said warning message is presented only graphically, for example, in order to increase the driver's attention overall and to avoid distraction by other influences as far as possible.

In one further development of the indication of the position of the emergency vehicle by a signal tone, it is possible to propose, in line with the invention, that the direction of the emergency vehicle be indicated by time-variant reproduction of the signal tone in the surround-sound-compatible loudspeaker installation taking account of the direction of movement of the emergency vehicle. In this case, the Doppler effect of the siren or of the special signal siren, which typically occurs in reality, can preferably also be simulated at the same time. This has the advantage that the features typically used by drivers to locate the emergency vehicle are retained in the senses even in the case of separate signaling of the position and direction of the emergency vehicle in line with the present invention.

The invention also relates to an apparatus for warning of emergency vehicles in emergency service. The apparatus is equipped with a receiver for receiving warning messages, transmitted by the emergency vehicles by means of vehicle-to-vehicle communication, in a receiving vehicle, having a control device for evaluating a received warning message and having an indicator device for indicating the warning message to the driver of the receiving vehicle. In line with the invention, the control device is set up to recognize from the warning message a position statement for the emergency vehicle relative to the position of the receiving vehicle and to actuate the indicator device such that the position of the emergency vehicle is indicated relative to the position of the driver's own vehicle. In this case, the positions can be identified on the basis of position coordinates in a navigation coordinate system or by evaluating radio signals, in particular, in the vehicle-to-vehicle communication. In particular, the control device is set up to perform the method described above or portions thereof and can produce or prompt the previously described presentations for indication in the indicator device by transmitting the relevant control commands to the indicator device.

In line with the invention, the indicator device may be a screen, for example a driver information display or the screen of a Human Machine Interface (HMI), and/or a surround-sound-compatible loudspeaker installation in which a signal tone is produced such that it appears to come from the direction of the emergency vehicle.

The apparatus according to aspects of the invention can easily be integrated into an existing driver information system as well and implemented there by means of suitable programming. The existing driver information systems usually already have interfaces to the components required for the apparatus according to aspects of the invention, so that the invention can be implemented particularly advantageously in this manner. In this case, the apparatus may also be in the form of a computer program product which sets up the components of the driver information system to perform the method described above. Naturally, the invention also allows the apparatus to have respective dedicated components for the implementation thereof.

In line with one preferred embodiment of the apparatus, an emergency vehicle may contain a transmitter for transmitting the warning messages which contain a position statement and possibly a direction statement. Said statements may either be present explicitly as information in a data or radio message or can be obtained implicitly by evaluating the parameters for the vehicle-to-vehicle communication, particularly for WLAN radio communication.

Further features, advantages and opportunities for application of the present invention can also be found in the description below of an exemplary embodiment and in the drawing. In this context, all the features described and/or shown in the figures form the subject matter of the present invention on their own or in any combination, including independently of their synopsis in the claims or the back-references therein.

BRIEF DESCRIPTION OF THE DRAWINGS

The invention is best understood from the following detailed description when read in connection with the accompanying drawings. Included in the drawings is the following figures.

DETAILED DESCRIPTION OF THE PREFERRED EMBODIMENTS

Figure 1:
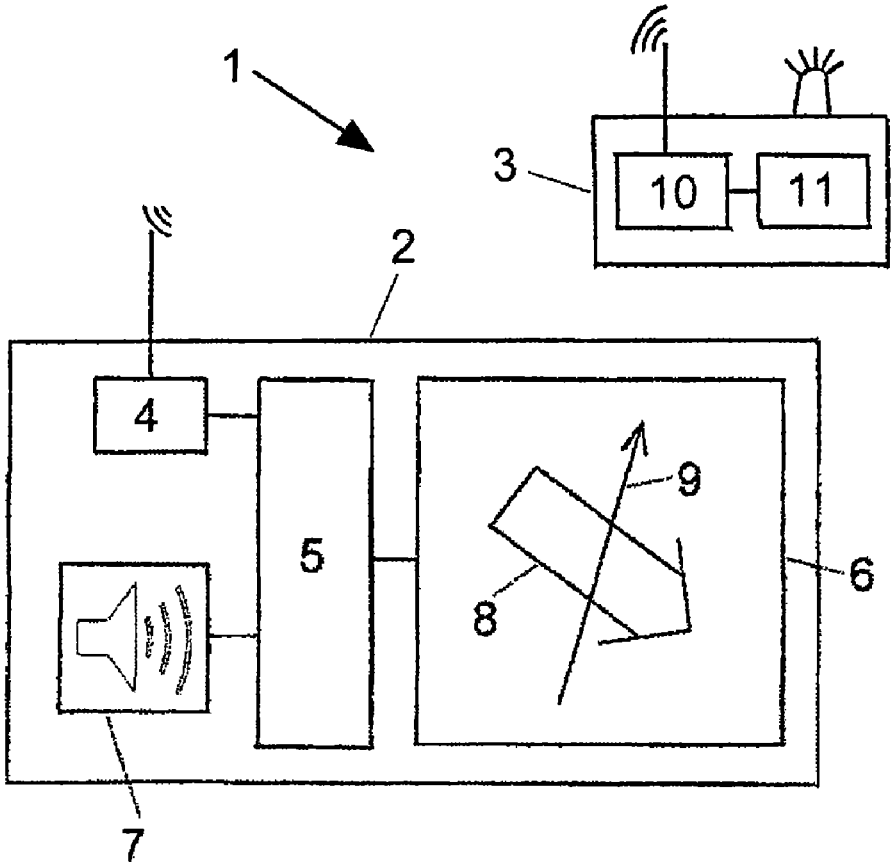
FIG. 1 schematically shows an apparatus according to aspects of the invention for warning of emergency vehicles in emergency service.

The schematic illustration shown in FIG. 1 shows an apparatus 1 for warning of emergency vehicles 3 in a receiving vehicle 2 which receives warning messages from emergency vehicles 3 in emergency service. To this end, the receiving vehicle 2 contains a receiver 4 which receives warning messages which have been transmitted by emergency vehicles 3 in emergency service using vehicle-to-vehicle communication, particularly WLAN radio communication. The receiver 4 in the receiving vehicle 2 is connected to a control device 5 which evaluates the warning message and which is set up to ascertain from the warning message a position statement for the emergency vehicle 3 relative to the position of the receiving vehicle 2. Following this evaluation, the control device 5 forwards the ascertained information to an indicator device 6, which is in the form of a display. In addition, the information can also be forwarded to an indicator device 7, which is in the form of a loudspeaker installation.

The text below first of all describes the presentation of the warning message on the display 6, which is a driver information display integrated in the instrument panel of the vehicle, for example. The display shows two arrows 8, 9, wherein the first arrow 8 shows the position of the emergency vehicle relative to the driver's own vehicle as a solid arrow, possibly with a color background. In an interpretation which is simple for the driver of the driver's own (receiving) vehicle 2, an upwardly pointing arrow 8 indicates an emergency vehicle 3 ahead of the driver's own vehicle 2. A downwardly pointing arrow indicates an emergency vehicle 3 behind the driver's own vehicle 2. In the chosen presentation, the emergency vehicle 3 is thus situated behind and to the right beside the receiving vehicle 2. The second arrow 9, which is presented in narrower and longer form, shows the direction of movement of the emergency vehicle 3, which, in the example arrangement shown in the display 6, is traveling almost parallel to the driver's own vehicle 2, i.e. in almost the same direction of movement.

Such a situation arises on a two-lane road, for example, when the emergency vehicle is traveling in a lane situated to the right beside the lane of the receiving vehicle 2 in the same direction.

In addition, the control device 5 can actuate a surround-sound-compatible loudspeaker installation 7, such that the driver is audibly given the impression, for the case of a traffic situation which is presented in the indicator device 6, that the emergency vehicle 3 is traveling behind and to the right beside it.

In order to simultaneously indicate the speed of the emergency vehicle, which can be obtained from an evaluation of the timing of the position signals for the emergency vehicle 3, for example, the direction arrow 9 can be presented in different lengths, with a long arrow 9 preferably inferring a high speed and a short arrow 9 preferably inferring a low speed. The length of the arrow 9 may be correlated to absolute speed values for the emergency vehicle 3 or can be determined relative to the receiving vehicle 2.

To allow the speed also to be heard audibly through the loudspeaker installation 7, provision may be made for the signal tone to be altered on the basis of the speed of the emergency vehicle 3 such that the position of the emergency vehicle 3 changes relative to the driver's own vehicle 2 when it is traveling slower or faster than the driver's own vehicle 2. In this context, the Doppler effect which is typical of sirens may also be employed at the same time.

The present invention is naturally not limited to the indicator devices 6, 7 described above and can also be implemented with other indicator devices which indicate the position and possibly the direction and speed of an emergency vehicle 2 in emergency service in a receiving vehicle 2.

The warning messages from the emergency vehicle 3 are transmitted by a transmitter 10 in the emergency vehicle 3, said transmission being initiated by a control device 11 in the emergency vehicle 3. The control device 11 is preferably connected to a vehicle information system, which is not shown in FIG. 1, and knows the position, direction of movement and speed of the emergency vehicle 3 in real time or can easily ascertain this information, for example from coordinates from a position-finding system. This information is then preferably concurrently transmitted in data messages on the WLAN radio link as part of the vehicle-to-vehicle communication.

Figure 2:
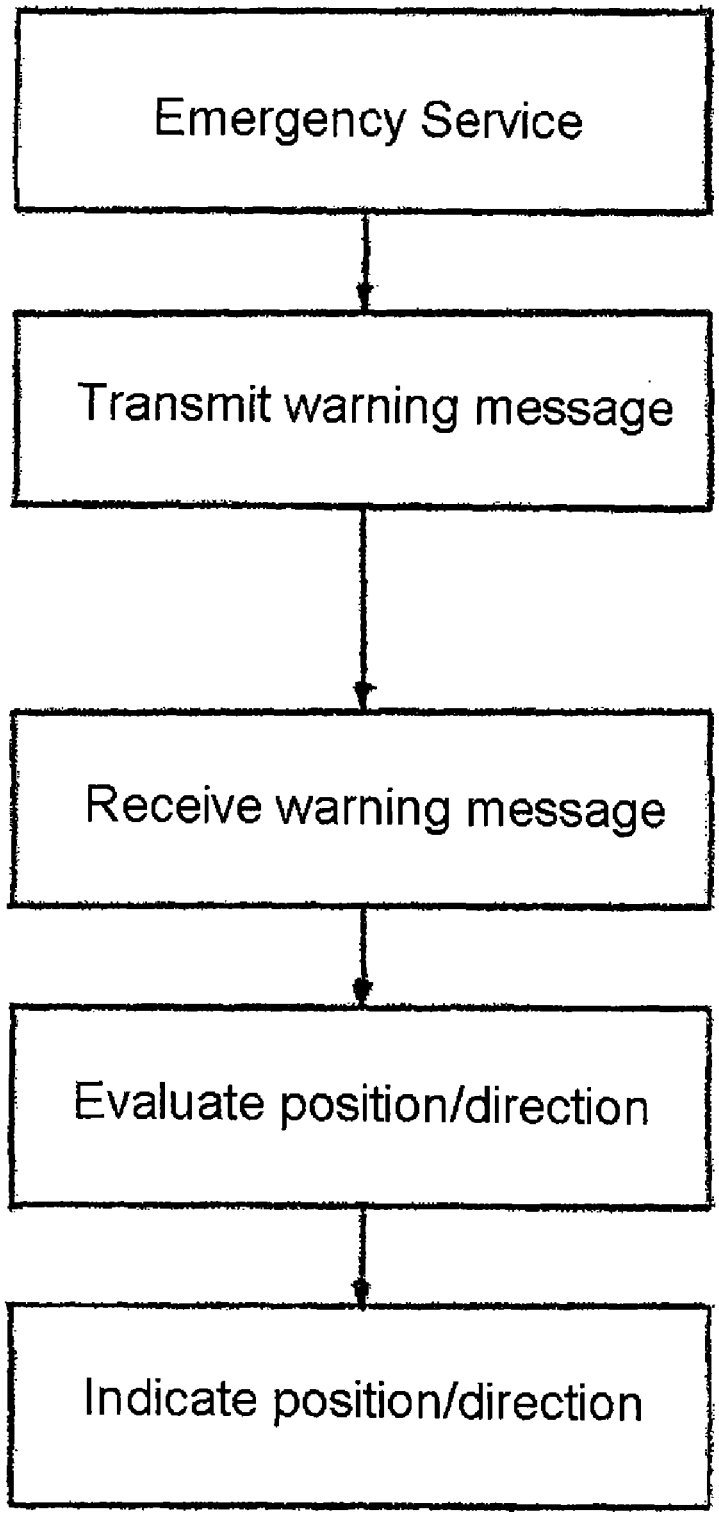
FIG. 2 shows a flowchart for the method according to aspects of the invention for warning of emergency vehicles.

FIG. 2 schematically shows the flow of the method according to aspects of the invention. When an emergency vehicle 3 is in emergency service, the transmission of warning messages is activated, which contain information about the position and direction of movement and also possibly the speed of the emergency vehicle. These warning messages are received in a receiving vehicle 2 in order to warn the driver of the receiving vehicle 2 and to point out the emergency vehicle 3 in emergency service.

A control device 5 evaluates the received warning messages in order to establish the position and preferably also the direction of movement of the emergency vehicle 3 relative to the receiving vehicle 2. In addition, the speed of the emergency vehicle 3 can in this case also be ascertained at the same time in absolute or relative terms with respect to the driver's own, receiving vehicle 2. This can easily be done on the basis of position coordinates in the coordinate system of a navigation or position-finding system.

As soon as the result of the evaluation is available, an indicator device 6, 7 indicates the position, direction and/or speed of the emergency vehicle 3 so as not only to warn the driver of the receiving vehicle 2 about the emergency vehicle but also, at the same time, to provide clear orientation with regard to the traffic situation and to allow the driver of the receiving vehicle 2 to react as appropriate.

The vehicle-to-vehicle communication can thus be used to inform the driver of a receiving vehicle 2 about the whereabouts and the direction of movement of the emergency vehicle 3 relative to the driver's own vehicle 2 and hence to increase road safety as a whole.

The invention claimed is:

1. A method for warning of emergency vehicles in emergency service, in which emergency vehicles use vehicle-to-vehicle communication to transmit warning messages which are received by an other vehicle and are indicated to a driver of the other vehicle, the method including the steps of:

transmitting, by the emergency vehicle, a warning message including a position of the emergency vehicle to the other vehicle, wherein in response to receiving the warning message and when the other vehicle is configured to perform map matching, the other vehicle performs map matching and indicates to the driver the position of the emergency vehicle relative to a position of the other vehicle, and wherein in response to receiving the warning message and when the other vehicle is not configured to perform map matching, the other vehicle transmits the position of the other vehicle to the emergency vehicle, the emergency vehicle performs map matching and transmits the position of the emergency vehicle relative to the position of the other vehicle, and the other vehicle indicates to the driver the position of the emergency vehicle relative to the position of the other vehicle.

2. The method as claimed in claim 1, wherein the position of the emergency vehicle is attributed to a position in a digital map.

3. The method as claimed in claim 2, wherein the position of the other vehicle is attributed to a position in a digital map.

4. The method as claimed in claim 2, wherein the position of the emergency vehicle and/or for the other vehicle is attributed in the emergency vehicle.

5. The method as claimed in claim 2, wherein a position and/or a direction of the emergency vehicle are/is indicated in the digital map.

6. The method as claimed in claim 1, wherein the position of the emergency vehicle is indicated by an arrow in an indicator device, an arrow tip of which points in a direction of the emergency vehicle relative to the other vehicle.

7. The method as claimed in claim 1, wherein a direction of the emergency vehicle is indicated by an arrow in an indicator device, an arrow tip of which points in the direction of movement of the emergency vehicle relative to the direction of travel of the other vehicle.

8. The method as claimed in claim 1, wherein the warning message from the emergency vehicle has a direction statement for the emergency vehicle.

9. The method as claimed in claim 1, wherein a position of the emergency vehicle is indicated by a signal tone in a surround-sound-compatible loudspeaker installation such that the signal tone appears to the driver of the other vehicle to come from a direction of approach.

10. The method as claimed in claim 9, wherein the direction of the emergency vehicle is indicated by time-variant reproduction in the surround-sound-compatible loudspeaker installation.

11. An apparatus for warning a driver of a receiving vehicle of a position of an emergency vehicle in emergency service comprising:

a receiver in a receiving vehicle for receiving a warning message that is transmitted by the emergency vehicle by vehicle-to-vehicle communication, the warning message including a position of the emergency vehicle;

a control device for evaluating the warning message; and an indicator device for indicating the warning message to the driver of the receiving vehicle, wherein in response to receiving the warning message and when the receiving vehicle is configured to perform map matching, the receiving vehicle performs map matching and indicates to the driver the position of the emergency vehicle relative to a position of the receiving vehicle, and wherein in response to receiving the warning message and when the receiving vehicle is not configured to perform map matching, the receiving vehicle transmits the position of the receiving vehicle to the emergency vehicle, the emergency vehicle performs map matching and transmits the position of the emergency vehicle relative to the position of the receiving vehicle, and the receiving vehicle indicates to the driver the position of the emergency vehicle relative to the position of the receiving vehicle.

12. The apparatus as claimed in claim 11, wherein the indicator device is a screen and/or a surround-sound-compatible loudspeaker installation.

13. The apparatus as claimed in claim 11, wherein the apparatus is integrated in a driver information system.

14. The apparatus as claimed in claim 11, wherein an emergency vehicle contains a transmitter for transmitting the warning messages which contain a position statement.

* * * * *